US009468323B2

(12) United States Patent
Gardner

(10) Patent No.: US 9,468,323 B2
(45) Date of Patent: Oct. 18, 2016

(54) BOTTLE BUDDY COVER

(71) Applicant: Ernest Gordon Gardner, Charlotte, MI (US)

(72) Inventor: Ernest Gordon Gardner, Charlotte, MI (US)

( * ) Notice: Subject to any disclaimer, the term of this patent is extended or adjusted under 35 U.S.C. 154(b) by 114 days.

(21) Appl. No.: 14/517,861

(22) Filed: Oct. 19, 2014

(65) Prior Publication Data

US 2016/0106247 A1 Apr. 21, 2016

(51) Int. Cl.
*B65D 81/38* (2006.01)
*A47G 23/02* (2006.01)

(52) U.S. Cl.
CPC ..... *A47G 23/0241* (2013.01); *B65D 81/3879* (2013.01); *A47G 2023/0275* (2013.01)

(58) Field of Classification Search
CPC ..... A47G 2200/02; A47G 23/0241; B65D 81/3879; B65D 81/3876
USPC ..... 220/560
See application file for complete search history.

(56) References Cited

U.S. PATENT DOCUMENTS

| | | | | |
|---|---|---|---|---|
| 1,790,299 | A * | 1/1931 | Foreman | B65D 81/3876 215/12.1 |
| 5,088,948 | A * | 2/1992 | Scheurer | A47G 19/2266 215/388 |
| 6,029,845 | A * | 2/2000 | Mueller | A47G 23/02 220/560 |
| 6,588,621 | B2 * | 7/2003 | Shimazaki | F25D 3/08 220/23.89 |
| 8,544,678 | B1 * | 10/2013 | Hughes | B65D 81/3879 220/737 |
| 2004/0142614 | A1 * | 7/2004 | Kirk | A47G 23/0216 441/130 |
| 2006/0091141 | A1 * | 5/2006 | Scott | A47G 23/0216 220/560 |
| 2006/0289545 | A1 * | 12/2006 | Spear | A01N 1/02 220/560.12 |
| 2009/0090732 | A1 * | 4/2009 | Trimarco | B65D 81/3876 220/739 |

* cited by examiner

*Primary Examiner* — Stephen Castellano

(57) ABSTRACT

The Bottle Buddy is a new product to help keep bottled beverages cold while allowing them to stand firmly on a flat surface and also fit firmly in today's modern cup or drink holders. The Bottle Buddy is buoyant so if dropped in water it floats whether bottle is full of fluid or empty. The main improvement to current products on the market is the fact that the Bottle Buddy stands on the bottle's own firm base and also allows for a firm grasp inside a cup holder. It provides for a nice comfortable grip on the beverage and provides floatation if dropped into the water while a bottle is inside the Bottle Buddy.

6 Claims, 2 Drawing Sheets

BOTTLE BUDDY COVER

CROSS-REFERENCE TO RELATED APPLICATIONS

Not Applicable

STATEMENT REGARDING FEDERALLY SPONSORED RESEARCH OR DEVELOPMENT (IF APPLICABLE)

Not Applicable

REFERENCE TO SEQUENCE LISTING, A TABLE, OR A COMPUTER PROGRAM LISTING COMPACT DISC APPENDIX (IF APPLICABLE)

Not Applicable

BACKGROUND OF THE INVENTION

I invented the Bottle Buddy as an improvement over currently available bottle insulators. I wanted to create a bottle insulator that would keep the beverage inside cold, insulate the hand holding the cold bottle, provide stability for the bottle when sitting on flat surfaces, and to fit in modern-day cup holders more securely than currently available bottle insulators. I wanted to make a bottle insulator that would be buoyant and keep bottled beverages from sinking in water (lakes, rivers, ponds). My current design of the Bottle Buddy fits a 12 oz bottle, but I would like to also make them to fit wine bottles.

BRIEF SUMMARY OF THE INVENTION

Bottle Buddy has advantages over previous products in that it allows a beverage bottle to sit on its own bottom as opposed to material between itself and surface supporting bottle making it unstable and unable to sit firmly on a table. The Bottle Buddy's design allows it to hold a 12 oz. bottle firmly in today's common cup holders whereas previously existing products don't. Bottle Buddy increases the buoyancy of bottled beverages therefore keeping them from sinking if dropped in water.

The bottle would be installed into the bottom of Bottle Buddy and as opposed to the top like current products on the market. Place bottle on flat stable surface and press bottle buddy over bottle until firmly seated over bottle, remove bottle cap, enjoy your beverage. To remove an empty bottle from Bottle Buddy, hold Bottle Buddy in one hand while pushing top of bottle back down and out.

BRIEF DESCRIPTION OF THE SEVERAL VIEWS OF THE DRAWING

1.

2.

3.

DETAILED DESCRIPTION OF THE INVENTION

Bottle Buddy is a 12 oz long neck bottle insulating cover that helps keep beverages cold. It is made of ½ inch closed-cell polyethylene foam (or similar). The Bottle Buddy is currently fabricated using a flat sheet of ½ inch closed-cell polyethylene foam. The foam sheet is heated in oven until very pliable. Once foam has reached mold-able temperature, it is draped over a bottle or bottle form and vacuum formed around the form of a bottle that the Bottle Buddy will serve. Once foam cools the bottom foam is cut off as is the foam that covers the neck of the bottle. The rest of the excess foam is trimmed and buffed to shape. The seam is then glued to complete the fabrication processes.

Figure 1A:
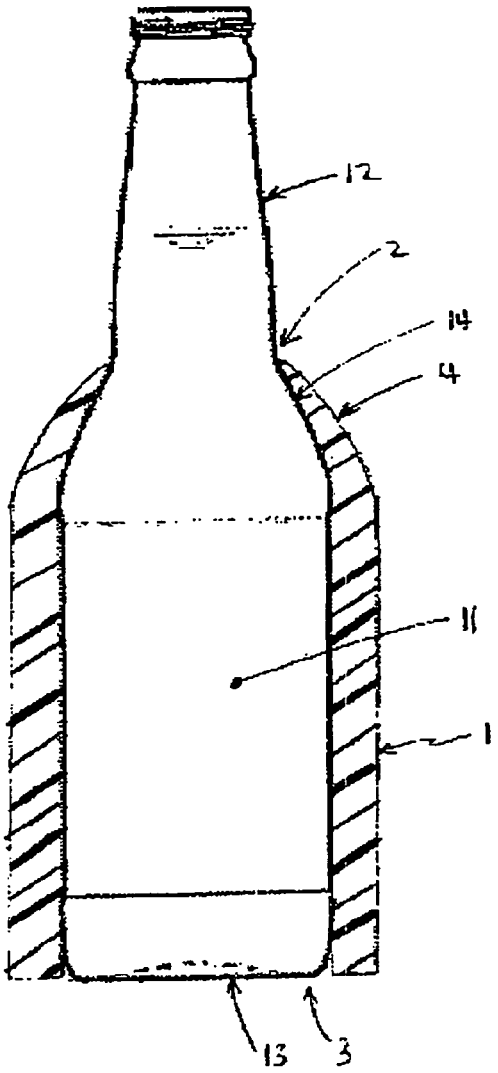
FIG. 1A depicts a cutout side view of the Bottle Buddy. The highlighted area represents the Bottle buddy foam which insulates the bottle. The foam is ½ inch thick, and tappers to the bottle neck. The bottom of the foam is cut square at bottom of the bottle at the base.
Figure 2A:
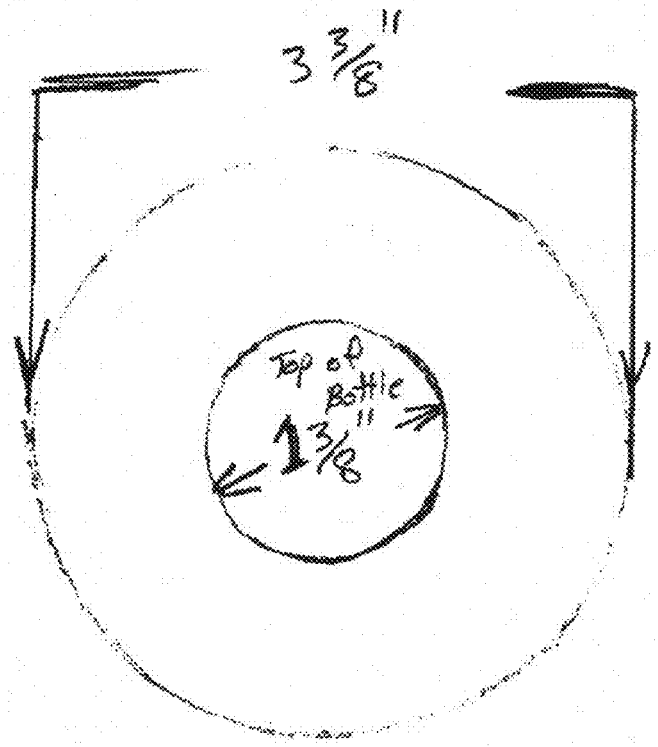
FIG. 2A depicts a top view of the bottle buddy. This drawing shows the outside dimension of the Bottle Buddy (3⅜"), and the inside dimension where foam is tapered and stops at the base of the bottle neck (1⅜").
Figure 2B:
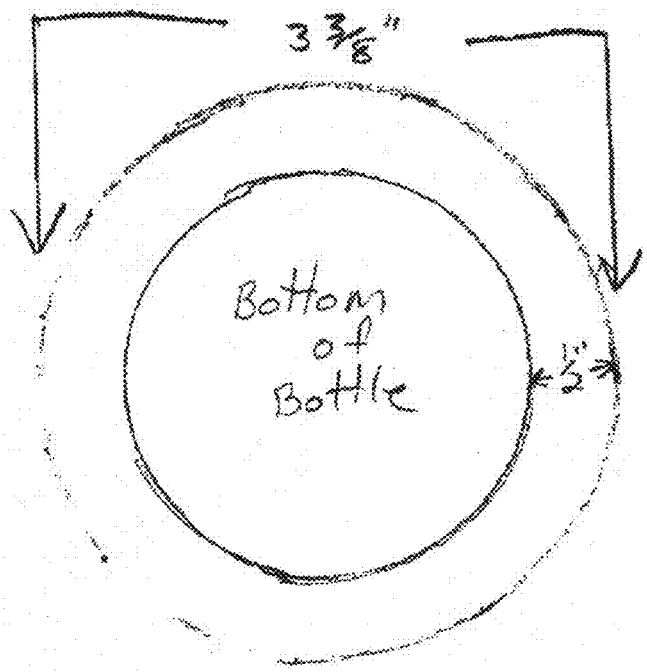
FIG. 2B depicts bottom view of Bottle Buddy. This drawing shows outside dimension of Bottle Buddy at its base (3⅜"). The thickness of Bottle Buddy (½"). The inside Diameter is 2⅜" as shown in FIG. 1A.

My vision is for this procedure to be replaced with an injection molding process to allow for production to keep up with demand which may include other types of foams. Foam is available in many colors and product logos can easily be applied if this product goes to market. FIGS. 1A, 2A, and 2B are drawings to help understand its final form. Prototypes have been made and field tested. FIG. 3A is an actual picture of a prototype.

As shown in FIG. 1A, the bottle cover is a sleeve 1 including a top open end 2, a bottom open end 3 and a radially inward extending shoulder 4 near the top open end. The bottom open end 3 is wider than the top open end 2 and allows a bottle 11 to be inserted only through the bottom open end 3. The narrower top open end 2 allows for the neck 12 of the bottle 11 to pass therethrough while stopping the upward progression of the bottle's insertion when the bottle's shoulder 14 abuts against the shoulder 4 of the sleeve. The bottom open end 3 of the sleeve allows a bottle bottom 13 to rest upon a flat surface in a stable manner.

The invention claimed is:

1. A bottle cover comprising an insulating sleeve made of a plastic material and designed to keep a chilled bottle and the chilled beverage inside cold for an extended period of time and insulate the user's hand from the chilled bottle, said sleeve including a top open end, a bottom open end and a radially inward extending shoulder near said top open end, said bottom open end is wider than said top open end and allows a bottle to be inserted only through said bottom open end, said narrower top end allows for the neck of a bottle to pass-therethrough while stopping the upward progression of the bottle's insertion when the bottle's shoulder abuts against said radially inward extending shoulder of said sleeve, said sleeve can be manufactured in varying sizes and shapes to fit bottles of various sizes and shapes, said bottom open end of said sleeve allows a bottle inserted therein to sit upon any flat surface in a stable manner, said sleeve fits modern-day cup holders more securely than currently available bottle insulators, wherein said sleeve has a thickness, said thickness is constant over a portion of said bottle that extends from said bottom open end to said radially inward extending shoulder, said thickness of said radially inward extending shoulder continually reduces from a greater thickness adjacent the bottom of said shoulder to a smaller thickness adjacent the top of said shoulder.

2. The bottle cover of claim 1, wherein said plastic material of said sleeve is a buoyant material which is capable of keeping the bottle and beverage combined with said sleeve from sinking in water.

3. The bottle cover of claim 2, wherein said plastic material is closed cell polyethylene foam.

4. The bottle cover of claim 3, wherein said sleeve has a maximum thickness of one-half inch.

5. The bottle cover of claim 1, wherein said sleeve has a maximum thickness of one-half inch.

6. The bottle cover of claim 1, wherein said sleeve has an inner surface capable of contacting a bottle outer surface and being firmly seated over the bottle.

* * * * *